US009287628B2

(12) United States Patent
Zeng

(10) Patent No.: US 9,287,628 B2
(45) Date of Patent: Mar. 15, 2016

(54) CIRCULAR POLARIZED ANTENNA STRUCTURE

(71) Applicant: LOROM INDUSTRIAL CO., LTD, Taipei (TW)

(72) Inventor: Bing Hao Zeng, Taichung (TW)

(73) Assignee: LOROM INDUSTRIAL CO., LTD., Taipei (TW)

( * ) Notice: Subject to any disclaimer, the term of this patent is extended or adjusted under 35 U.S.C. 154(b) by 210 days.

(21) Appl. No.: 13/961,493

(22) Filed: Aug. 7, 2013

(65) Prior Publication Data

US 2014/0340263 A1 Nov. 20, 2014

(30) Foreign Application Priority Data

May 17, 2013 (TW) ..... 102209201

(51) Int. Cl.
*H01Q 1/38* (2006.01)
*H01Q 9/04* (2006.01)

(52) U.S. Cl.
CPC ..... *H01Q 9/0428* (2013.01); *H01Q 1/38* (2013.01)

(58) Field of Classification Search
USPC ..... 343/700 MS, 715
See application file for complete search history.

(56) References Cited

U.S. PATENT DOCUMENTS 5,963,170 A * 10/1999 Garner et al. ..... 343/702
2008/0272969 A1* 11/2008 Tengler et al. ..... 343/715
2009/0015510 A1* 1/2009 Nakata et al. ..... 343/878

FOREIGN PATENT DOCUMENTS

TW I348783 9/2011

* cited by examiner

*Primary Examiner* — Tan Ho
(74) *Attorney, Agent, or Firm* — Muncy, Geissler, Olds & Lowe, P.C.

(57) ABSTRACT

Disclosed is a circular polarized antenna structure, comprising a main body, a protruding portion and a stopping portion, the stopping portion being formed between the main body and the protruding portion. The circular polarized antenna may be disposed to penetrate through the upper and lower surfaces of a base that has a radiation conductor and a grounding conductor disposed thereon respectively, the stopping portion abutting against the lower surface of the base to prevent the main body from coming loose and being detached from the base even if the protruding portion is subjected to a great impact or squeezing pressure caused by an external force coming from the lower surface upwards.

7 Claims, 5 Drawing Sheets

CIRCULAR POLARIZED ANTENNA STRUCTURE

BACKGROUND OF THE INVENTION

1. Field of the Invention

The present invention relates to an antenna structure, and, more particularly, to an improved circular polarized antenna structure.

2. Description of Related Art

An antenna structure is an essential device for receiving different wireless signals such as radio frequency, amplitude modulation frequency, Global Positioning Systems (GPS), Global Systems for Mobile Communications (GSM), wireless network (Wi-Fi), and for subsequent signal processing.

An antenna body may have a variety of shapes and structures in order to adapt to different sizes of wireless signal transmission/reception devices or ambient environments to obtain a greater signal gain. As such, circular polarized antennas have been developed to have a compact structure in view of different usages and applications.

Taiwanese Patent Publication No. I348783 discloses a circular polarized plate antenna structure, i.e. a circular polarized antenna. There exists a technical defect in this kind of circular polarized antenna, for instance, in applications of such antennas to a GPS apparatus for vehicle use, it is necessary that the circular polarized antenna be disposed on a substrate in order to protrude from the base of the circular polarized antenna body, which necessitates provisions of corresponding through holes penetrating through the substrate for the antenna to be mounted thereon. However, if the circular polarized antenna body does not align precisely with the through hole in the assembly process, or the force imposed on the circular polarized antenna is toward the position of the substrate without the through hole, the bonding strength therebetween would not be strong enough to resist the counter force imposed on the circular polarized antenna body since the components are soldered together merely on the top end, the base and a radiation conductor, thereby adversely causing the circular polarized antenna to snap outwards and thus detach from the base and causing the damage and inferior yield of the product as a result.

To resolve the foregoing technical problem, it is beneficial to propose a novel circuit polarized antenna that has sufficient inherent structural strength for resisting and rebutting the counter force in the assembly process.

SUMMARY OF THE INVENTION

In view of the drawbacks associated with the prior techniques, the invention proposes a novel circuit polarized antenna structure, which comprises a main body, a protruding portion and a stopping portion formed between the main body and the protruding portion.

In one preferred embodiment of the present invention, the protruding portion is slightly smaller in cross-section surface area than the main body.

In one preferred embodiment of the present invention, the circuit polarized antenna structure further includes a base having at least an via hole; a radiation conductor disposed on an upper surface of the base, and having at least a first through hole disposed at an upper position corresponding to the via hole; a grounding conductor disposed on a lower surface of the base and having at least a second through hole disposed at a lower position corresponding to the via hole; and solder, wherein the main body is disposed to penetrate the second through hole and the via hole, and one end of the main body with respect to the stopping portion and the first through hole are covered by the solder, and the stopping portion abuts against one end of the via hole close to the second through hole.

In one preferred embodiment of the present invention, the circuit polarized antenna structure further comprises a base having at least an via hole, one end of the via hole close to the second through hole having a recessed portion formed thereon; a radiation conductor disposed on the upper surface of the base and at least a first through hole is formed at an upper position with respect to the via hole; a grounding conductor disposed on the lower surface of the base and at least a second through hole is formed at a lower position with respect to the via hole; and solder, wherein the main body is disposed to penetrate the second through hole and the via hole, and one end of the main body with respect to the stopping portion and the first through hole are covered by the solder, and the stopping portion abuts against the recessed portion.

In one preferred embodiment of the present invention, one end of the main body with respect to the stopping portion has an extension portion formed thereon.

In one preferred embodiment of the present invention, the extension portion is slightly smaller in cross-section surface area than the main body, and the protruding portion is slightly smaller in cross-section surface area than the main body.

In one preferred embodiment of the present invention, the circuit polarized antenna structure further comprises a base having at least an via hole; a radiation conductor disposed on the upper surface of the base and at least a first through hole is formed at an upper position with respect to the via hole; a grounding conductor disposed on the lower surface of the base and at least a second through hole is formed at a lower position with respect to the via hole; and solder, wherein the main body and the extension portion are disposed to penetrate the second through hole and the via hole, and one end of the main body with respect to the stopping portion, the extension portion and the first through hole are covered by the solder, and the stopping portion abuts against one end of the via hole close to the second through hole.

In one preferred embodiment of the present invention, the circuit polarized antenna structure further comprises a base having at least an via hole, one end of the via hole close to the second through hole having a recessed portion formed thereon; a radiation conductor disposed on the upper surface of the base and at least a first through hole is formed at an upper position with respect to the via hole; a grounding conductor disposed on the lower surface of the base and at least a second through hole is formed at an lower position with respect to the via hole; and solder, wherein the main body and the extension portion are disposed to penetrate the second through hole and the via hole, and one end of the main body with respect to the stopping portion, the extension portion and the first through hole are covered by the solder, and the stopping portion abuts against the recessed portion.

In one preferred embodiment of the present invention, the circuit polarized antenna structure further comprises a base having at least an via hole; a radiation conductor disposed on the upper surface of the base and at least a first through hole is formed at an upper position with respect to the via hole; a grounding conductor disposed on the lower surface of the base and at least a second through hole is formed at an lower position with respect to the via hole; and solder, wherein the via hole has a conductive layer formed at positions close to the walls and/or the peripheral of the first through hole, and wherein the main body and the extension portion are disposed to penetrate the second through hole and the via hole, and one end of the main body with respect to the stopping portion, the extension portion and the first through hole are covered by the solder, and the stopping portion abuts against one end of the via hole close to the second through hole.

In one preferred embodiment of the present invention, the circuit polarized antenna structure further comprises a base having at least an via hole, one end of the via hole close to the second through hole having a recessed portion formed thereon; a radiation conductor disposed on the upper surface of the base and at least a first through hole is formed at an upper position with respect to the via hole; a grounding conductor disposed on the lower surface of the base and at least a second through hole is formed at an lower position with respect to the via hole; and solder, wherein the via hole has a conductive layer formed at positions close to the walls and/or the peripheral of the first through hole, and wherein the main body and the extension portion are disposed to penetrate the second through hole and the via hole, and one end of the main body with respect to the stopping portion, the extension portion and the first through hole are covered by the solder, and the stopping portion abuts against the recessed portion.

Compared to prior techniques, the circular polarized antenna structure of the invention is characterized by employing a stopping mechanism for abutting against the surface of the base facing the substrate through hole when being incorporated with the base, so that in the assembly process even if a force is exerted upon the circular polarized antenna body that is not aligning properly or precisely with the through hole of the substrate, the circular polarized antenna body can still resist the counter force imposed thereupon to remain intact on the base. Further, the circular polarized antenna structure of the invention also includes an extension portion and a conductive layer formed with respect to the base to allow the solder paste to flow on the through hole of the base that is to be incorporated to the radiation conduction to thus increase the contact surface area of the solder and the base and the radiation conductor, thereby increasing the bonding strength of the circular polarized antenna body and the base as well as the transmission efficiency of wireless signals.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE PREFERRED EMBODIMENTS

The following illustrative embodiments are provided to illustrate the disclosure of the present invention, these and other advantages and effects can be understood by persons skilled in the art after reading the disclosure of this specification. Note that the structures, proportions, sizes depicted in the accompanying figures merely serve to illustrate the disclosure of the specification to allow for comprehensive reading without a limitation to the implementation or applications of the present invention, and does not constitute any substantial technical meaning.

Figure 1A:
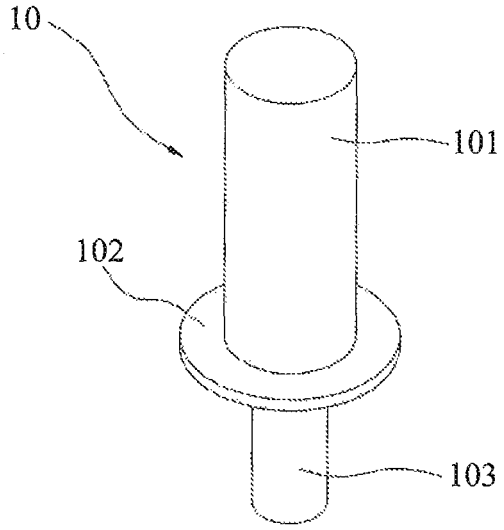
FIG. 1*a* illustrates a schematic view of the circular polarized antenna structure in accordance with a first preferred embodiment of the present invention.

Referring to FIG. 1*a*, a schematic view of the circular polarized antenna structure in accordance with a first preferred embodiment of the present invention is illustrated. As shown, the circular polarized antenna structure of this invention comprises a main body 101, a stopping portion 102 and a protruding portion 103, the stopping portion 102 being formed between the body 101 and the protruding portion 103. In this embodiment, the main body 101, the stopping portion 102 and the protruding portion 103 are, but not limited to, circular, and the protruding portion 103 is slightly smaller in cross-section surface area than the main body 101, and the stopping portion 102 is slightly larger in cross-section surface area than the main body 101 in order to block the main body 101. The details thereof will be described subsequently.

In other embodiment or according to the actual application, the foregoing elements may be in the shape of a polygon column, and the cross-section surface area of the protruding portion 103 may be slightly larger than or equal to the cross-section surface area of the main body 101.

Figure 1B:
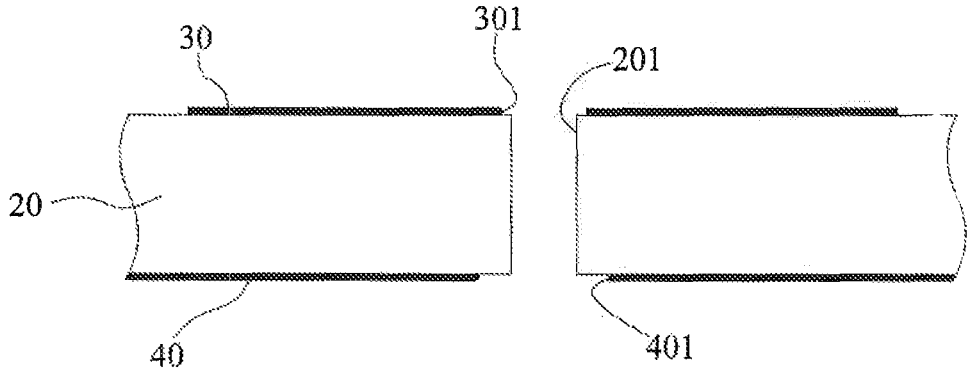
FIGS. 1*b*-1*d* are cross-section views of incorporating the circular polarized antenna with the base in accordance with a first preferred embodiment of the present invention.
Figure 1C:
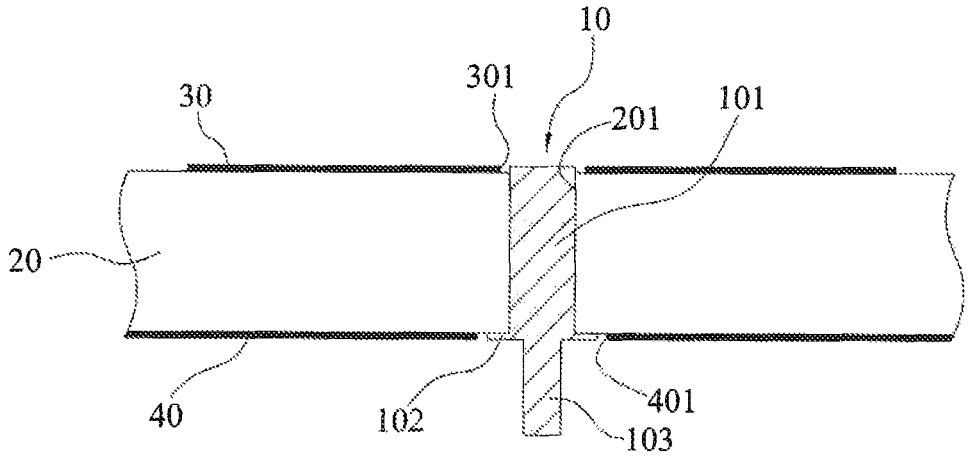
Figure 1D:
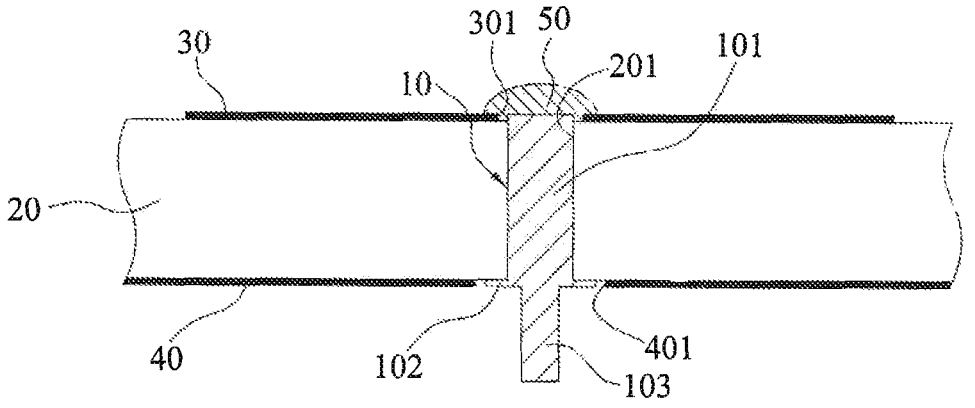

Referring to FIGS. 1*b*-1*d*, as shown the circular polarized antenna structure 10 may be incorporated with a base 20, the base 20 being made of a high dielectric ceramic material. Specifically, the base 20 comprises at least an via hole 201, a radiation conductor 30 disposed on an upper surface of the base 20, and at least a first through hole 301 formed at an upper position corresponding to the via hole 201. The grounding conductor 40 is disposed on the lower surface of the base 20 and at least a second through hole 401 is formed at a lower position corresponding to the via hole 201. In this embodiment, the radiation conductor 30 and the grounding conductor 40 are made of materials including but not limited to silver. In other embodiment, the radiation conductor 30 and the grounding conductor 40 can be made of conductive materials of copper or gold.

In this embodiment, the cross-section surface area of the via hole 201 may be slightly larger than or equal to the cross-section surface area of the main body 101, and the cross-section surface area of the second through hole 401 may be slightly larger than or equal to the cross-section surface area of the stopping portion 102.

In assembling the circular polarized antenna structure 10 with the base 20, as shown in FIG. 1*c*, one of the main body 101 of the circular polarized antenna structure 10 penetrates the second through hole 401 and passes through the via hole 201 to expose from the first through hole 301.

As shown in FIG. 1*d*, the solder 50 is used to cover one end of the stopping portion 102 with respect to the main body 101 and the peripheral of the first through hole 301, and the stopping portion 102 abuts against the end of the via hole 201 close to the second through hole 401, thereby fastening the circular polarized antenna structure 10 onto the base 20.

In the subsequent product manufacturing processes, the protruding portion 103 is adapted to pass the through hole of the substrate (not shown) when the base 20 of the circular polarized antenna structure 10 is to be mounted on a substrate (not shown), so that the circular polarized antenna structure 10 can resist the counter force of pressing without being detached from the base 20 even if the protruding portion 103 is not precisely aligned with the through hole of the substrate and being pressed by forces exerted thereupon, since the stopping portion 102 abuts against one end of the via hole 201 close to the second through hole 401.

Figure 2A:
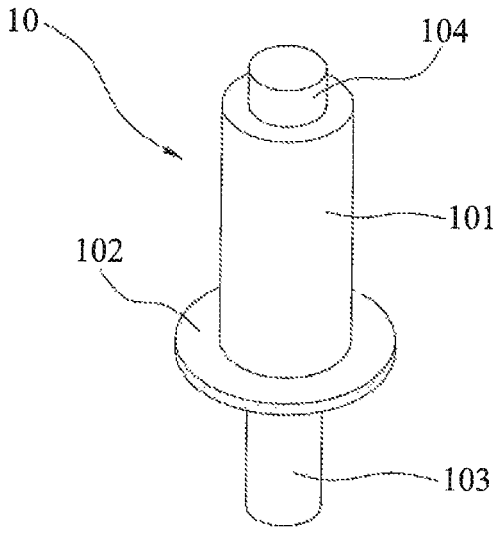
FIG. 2*a* illustrates a schematic view of the circular polarized antenna structure in accordance with a second preferred embodiment of the present invention.
Figure 2B:
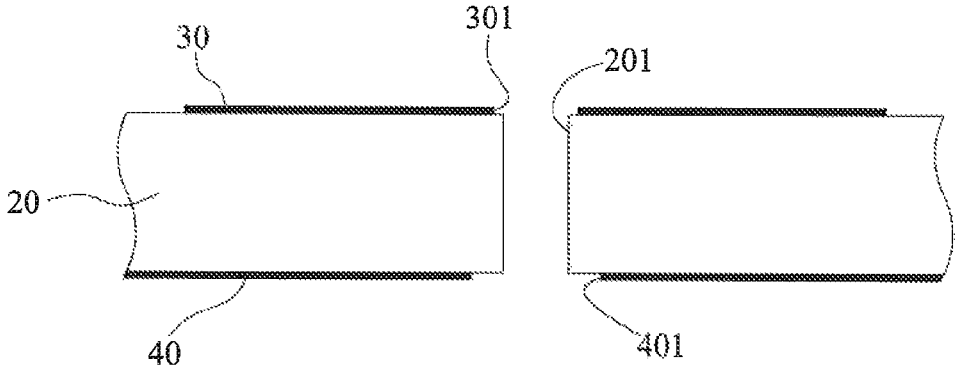
FIGS. 2*b*-2*d* are cross-section views of incorporating the circular polarized antenna with the base in accordance with a second preferred embodiment of the present invention.

Referring to FIG. 2*a*, a schematic view of the circular polarized antenna structure 10 in accordance with a second preferred embodiment of the present invention is illustrated. As shown, the constituent elements of the circular polarized antenna structure 10 of this embodiment are substantially the same as those of the previous first embodiment, except that an extension portion 104 is added to one end of the main body 101 with respect to the stopping portion 102. In this embodiment, the extension portion 104 is slightly smaller in cross-section surface area than the main body 101, and the extension portion 104 may also optionally be slightly larger in cross-section surface area than or equal to the protruding portion 103.

Further, the second embodiment differs from the previous first embodiment in that a conductive layer 60 is added to the walls and peripherals of the via hole 201 close to the first through hole 301, the material of the conductive layer 60 may be the same as the material of the radiation conductor 30 which can be silver or copper or gold. In other embodiment, the conductive layer 60 may optionally and specifically be disposed at the walls and peripherals of the via hole 201 close to the first through hole 301.

Figure 2C:
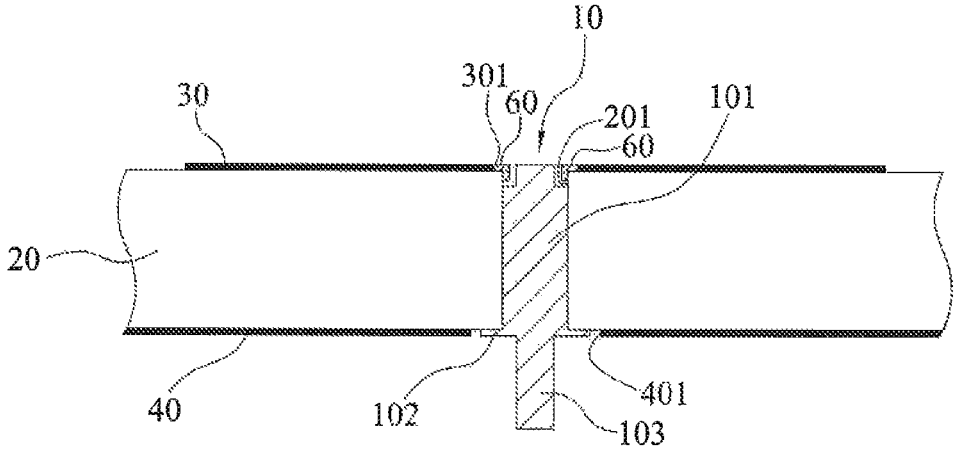

As shown in FIG. 2*c*, when assembling the circular polarized antenna structure 10 to the base 20, the main body 101 of the circular polarized antenna structure 10 and the end that has the extension portion 104 formed thereon will penetrate through the second through hole 401 and the via hole 201 and then be exposed from the first through hole 301.

Figure 2D:
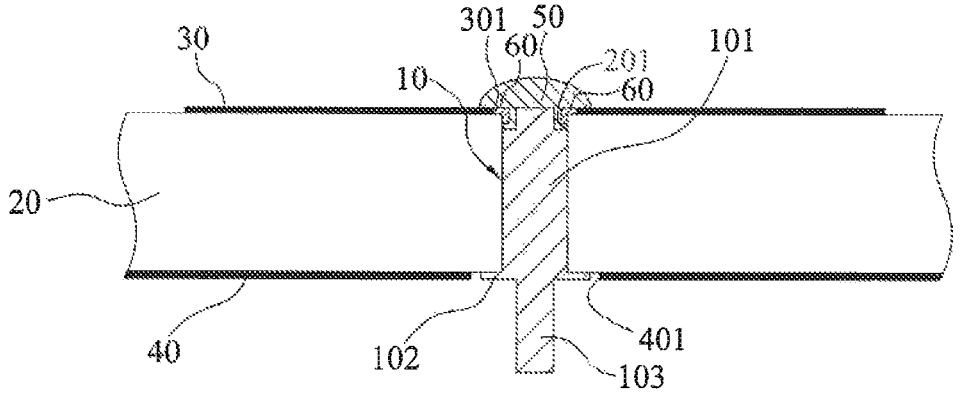

Subsequently, as shown in FIG. 2*d*, the solder 50 is used to cover one end of the stopping portion 102 with respect to the main body 101, the extension portion 104 and the peripheral of the first through hole 301, while the stopping portion 102 abuts against the end of the via hole 201 close to the second through hole 401. Compared with the first embodiment, the solder 50 goes deeper into the via hole 201 because the via hole 201 close to the first through hole 301 further has a conductive layer 60 disposed at the walls and peripherals thereof, thereby increasing the structural strength of the circular polarized antenna structure 10 to resist exterior counter forces but also have a greater signal gain due to the expansion of the contact surface area of the circular polarized antenna structure 10 and the radiation conductor 30. In particular, the conductive layer 60 may optionally be disposed at the walls and peripherals of the via hole 201 close to the first through hole 301 as described above.

Figure 3A:
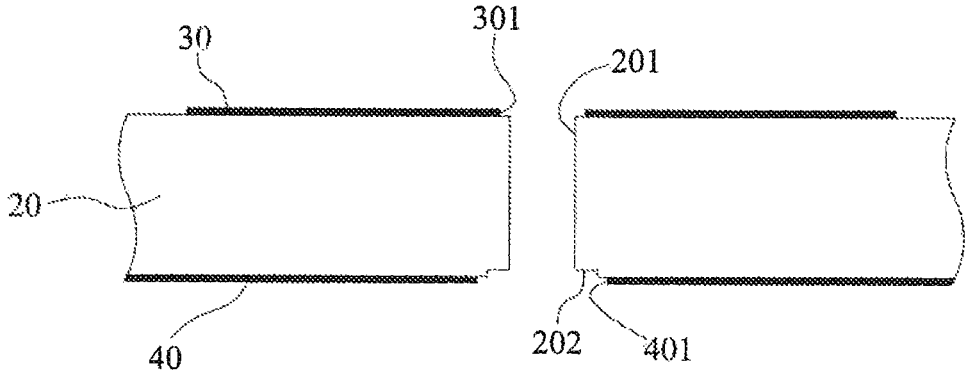
FIGS. 3*a*-3*c* are cross-section views of the circular polarized antenna in accordance with a third preferred embodiment of the present invention.
Figure 3B:
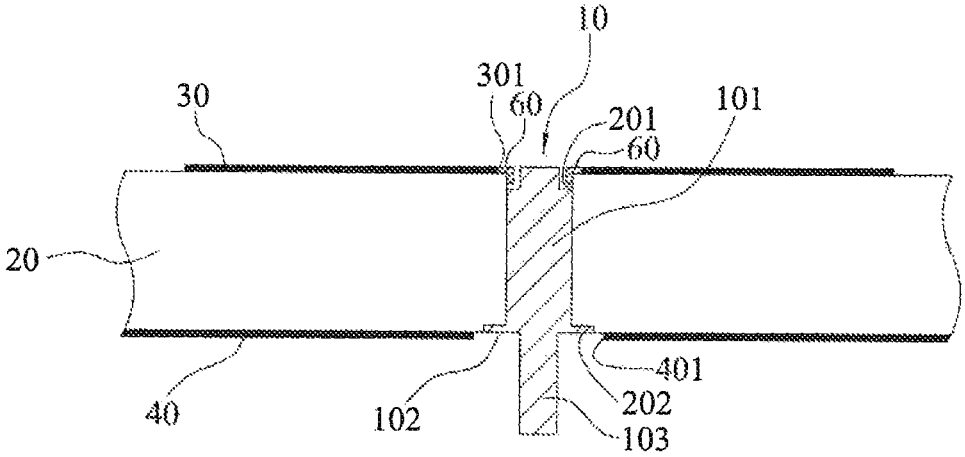
Figure 3C:
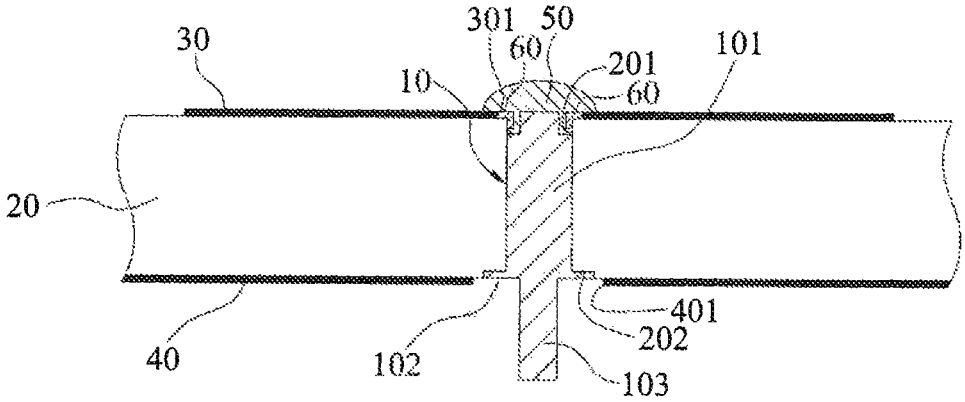

Referring to FIGS. 3*a* to 3*c*, a schematic view of the circular polarized antenna structure 10 in accordance with a third preferred embodiment of the present invention is illustrated. As shown, the constituent elements of the circular polarized antenna structure 10 of this embodiment are substantially the same as those of the previous second embodiment, except that a recessed portion 202 is added to one end of the second via hole 201 of the base 20 at a position close to one end of the second through hole 401 of the grounding conductor 40. In this embodiment, the recessed portion 201 constitutes a space for accommodating the stopping portion 102 therein such that the stopping portion 102 and the lower surface of the base 20 form a coplanar surface. In practice, the cross-section surface area of the recessed portion 202 is equal to or slightly larger than the cross-section surface area of the stopping portion 202, and the height of the recessed portion 202 may also be equal to or slightly larger than the height of the stopping portion 102.

It should be noted that after reading the descriptions and figures disclosed in the specification of this invention, persons having ordinary knowledge and skilled in the art would readily comprehend that the circular polarized antenna structure as disclosed in the first and second embodiments may well be incorporated to the base and the elements incorporated to the base (such as the radiation conductor, the grounding conductor, solder or the conductive layer) in either the first, second or the third embodiment respectively.

Similarly, the circular polarized antenna structure as disclosed in the second embodiment may well be incorporated to the base and the elements incorporated to the base (such as the radiation conductor, the grounding conductor, or the tin paste) as disclosed in the first embodiment.

Summarizing the above, the invention is characterized by employing a stopping portion to abut against the surface of the base facing the substrate via hole, so that the circular polarized antenna structure can resist the counter force of pressing without being detached from the base even if the protruding portion is not precisely aligned with the through hole of the substrate and being pressed by forces exerted thereupon, since the stopping portion abuts against one end of the via hole close to the second through hole. Further, the invention is also characterized by including an extension portion and a conductive layer formed at a corresponding position of the base, which allows solder paste to flow onto the via hole of the base to be incorporated with the radiation conductor and thus increase the contact surface area of the solder tin and base and the radiation conductor to enhance the structural strength and signal transmission efficiency of the circular polarized antenna.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A circular polarized antenna structure, comprising
- a main body;
- a protruding portion;
- a stopping portion formed between the main body and the protruding portion; and
- an extension portion formed at one end of the main body with respect to the stopping portion,
- wherein the cross section surface area of the extension portion is slightly smaller than the cross section surface area of the main body, and the cross section surface area of the protruding portion is slightly smaller than the cross section surface area of the main body.

2. The circular polarized antenna structure as claimed in claim 1, further comprising:
- a base having at least an via hole;
- a radiation conductor disposed on the upper surface of the base, and at least a first through hole is formed at an upper position with respect to the via hole;
- a grounding conductor disposed on the lower surface of the base, and at least a second through hole is formed at an lower position with respect to the via hole; and
- solder,
- wherein the main body and the extension portion are disposed to penetrate the second through hole and the via hole, and one end of the main body with respect to the stopping portion, the extension portion and the first through hole are covered by the solder, and the stopping portion abuts against one end of the via hole close to the second through hole.

3. The circular polarized antenna structure as claimed in claim 1, further comprising:

a base having at least an via hole; one end of the via hole close to the second through hole having a recessed portion formed thereon;

a radiation conductor disposed on the upper surface of the base, and at least a first through hole is formed at an upper position with respect to the via hole;

a grounding conductor disposed on the lower surface of the base, and at least a second through hole is formed at an lower position with respect to the via hole; and solder, wherein the main body and the extension portion are disposed to penetrate the second through hole and the via hole, and one end of the main body with respect to the stopping portion, the extension portion and the first through hole are covered by the solder, and the stopping portion abuts against the recessed portion.

4. The circular polarized antenna structure as claimed in claim 1, further comprising:

a base having at least an via hole;

a radiation conductor disposed on the upper surface of the base, and at least a first through hole is formed at an upper position with respect to the via hole;

a grounding conductor disposed on the lower surface of the base, and at least a second through hole is formed at an lower position with respect to the via hole; and solder, wherein a conductive layer is formed at the walls and/or peripherals of the via hole close to the first through hole, and wherein the main body and the extension portion are disposed to penetrate the second through hole and the via hole, and one end of the main body with respect to the stopping portion, the extension portion and the first through hole are covered by the solder, and the stopping portion abuts against one end of the via hole close to the second through hole.

5. The circular polarized antenna structure as claimed in claim 1, further comprising:

a base having at least an via hole; one end of the via hole close to the second through hole having a recessed portion formed thereon;

a radiation conductor disposed on the upper surface of the base, and at least a first through hole is formed at an upper position with respect to the via hole;

a grounding conductor disposed on the lower surface of the base, and at least a second through hole is formed at an lower position with respect to the via hole; and solder, wherein a conductive layer is formed at the walls and/or peripherals of the via hole close to the first through hole, and wherein the main body and the extension portion are disposed to penetrate the second through hole and the via hole, and one end of the main body with respect to the stopping portion, the extension portion and the first through hole are covered by the solder, and the stopping portion abuts against the recessed portion.

6. A circular polarized antenna structure, comprising:

a main body;

a protruding portion;

a stopping portion formed between the main body and the protruding portion;

a base having at least an via hole;

a radiation conductor disposed on the upper surface of the base, and at least a first through hole is formed at an upper position with respect to the via hole;

a grounding conductor disposed on the lower surface of the base, and at least a second through hole is formed at an lower position with respect to the via hole; and solder, wherein the main body is disposed to penetrate the second through hole and the via hole, and one end of the main body with respect to the stopping portion and the first through hole are covered by the solder, and the stopping portion abuts against one end of the via hole close to the second through hole.

7. A circular polarized antenna structure, comprising:

a main body;

a protruding portion;

a stopping portion formed between the main body and the protruding portion;

a base having at least an via hole, one end of the via hole close to the second through hole having a recessed portion formed thereon;

a radiation conductor disposed on the upper surface of the base, and at least a first through hole is formed at an upper position with respect to the via hole;

a grounding conductor disposed on the lower surface of the base, and at least a second through hole is formed at an lower position with respect to the via hole; and solder, wherein the main body is disposed to penetrate the second through hole and the via hole, and one end of the main body with respect to the stopping portion and the first through hole are covered by the solder, and the stopping portion abuts against the recessed portion.

* * * * *